US006302922B1

(12) United States Patent
Kanehisa

(10) Patent No.: US 6,302,922 B1
(45) Date of Patent: Oct. 16, 2001

(54) PROCESS FOR MANUFACTURING WOVEN OR KNIT FABRICS HAVING EXCELLENT SHRINK AND CREASE RESISTANCE AND SHAPE STABILITY BY USING SERICIN FIXED YARNS OF RAW SILKS AND THE WOVEN OR KNIT FABRICS MANUFACTURED BY THE SAME PROCESS

(75) Inventor: Keiichiro Kanehisa, Takeno-gun (JP)

(73) Assignee: Sumitomo Corporation, Osaka (JP)

( * ) Notice: Subject to any disclaimer, the term of this patent is extended or adjusted under 35 U.S.C. 154(b) by 0 days.

(21) Appl. No.: 09/194,716

(22) PCT Filed: Aug. 7, 1997

(86) PCT No.: PCT/JP97/02741

§ 371 Date: Dec. 17, 1998

§ 102(e) Date: Dec. 17, 1998

(87) PCT Pub. No.: WO99/07934

PCT Pub. Date: Feb. 18, 1999

Related U.S. Application Data

(63) Continuation-in-part of application No. 08/836,971, filed as application No. PCT/JP96/01019 on Apr. 12, 1996, now Pat. No. 5,849,040.

(30) Foreign Application Priority Data

Feb. 23, 1996 (JP) ..... 8-61825

(51) Int. Cl.[7] ..... D06M 13/358; D06P 1/382; D06P 5/22; D06P 7/00

(52) U.S. Cl. ..... 8/401; 8/128.1; 8/494; 8/485; 8/529; 8/917

(58) Field of Search ..... 8/401, 549, 494, 8/917, 128.1, 485, 529

(56) References Cited

U.S. PATENT DOCUMENTS

| | | |
|---|---|---|
| 836,464 | 11/1906 | Schmid . |
| 1,332,675 | 3/1920 | Maupai . |
| 1,366,705 | 1/1921 | Rosenstock . |
| 1,486,292 | 3/1924 | Maupai . |
| 5,538,519 | 7/1996 | Horiguchi . |
| 5,849,040 | 12/1998 | Kanehisa . |

FOREIGN PATENT DOCUMENTS

| | | |
|---|---|---|
| 40-8050 | 4/1965 | (JP) . |
| 59-192771 | 11/1984 | (JP) . |
| 61-34274 | 2/1986 | (JP) . |
| 3-57205 | 8/1991 | (JP) . |
| 53-81788 | 7/1998 | (JP) . |

*Primary Examiner*—Margaret Einsmann
(74) *Attorney, Agent, or Firm*—Ostrager Chong & Flaherty LLP

(57) ABSTRACT

There is provided a process for manufacturing woven or knitted fabrics comprising modifying the woven or knitted fabrics by applying a skeleton triazine cross-linking reaction using a sericin fixing method of raw silk to enhance its shrink and crease resistance and shape stability and thereafter removing the sericin using a special scouring.

The process for manufacturing a woven or knitted fabric, comprises the steps of finishing and treating raw silk and/or cellulose fibers by using a silk sericin fixing method; doubling and twisting thus finished/treated raw silk and/or cellulose fibers; weaving or knitting the doubled and twisted yarns; swelling the woven or knitted fabric forming a cloth by dipping it in a bath; and, scouring the woven or knitted fabric swelled in the bath with an enzyme whereby the woven or knitted fabric is provided with shrink and crease resistance and shape stability.

32 Claims, 10 Drawing Sheets

PROCESS FOR MANUFACTURING WOVEN OR KNIT FABRICS HAVING EXCELLENT SHRINK AND CREASE RESISTANCE AND SHAPE STABILITY BY USING SERICIN FIXED YARNS OF RAW SILKS AND THE WOVEN OR KNIT FABRICS MANUFACTURED BY THE SAME PROCESS

This application is a 371 of PCT/JP97/02741 filed Aug. 7, 1997 and continuation-in-part of Ser. No. 08/836,971 filed May 22, 1997 now U.S. Pat. No. 5,349,040 which is a 371 of PCT/ JP96/01019 filed Apr. 12, 1996.

BACKGROUND OF THE INVENTION

The art of manufacturing fabrics using silk which is a natural material has been traditionally succeeded. The fabrics have specific feeling, beautiful gloss and softness, in particular both air-permeability and hygroscopicity properties.

The silk yarn comprises a pair of fibroin portions, which is covered with an outer layer of sericin. The so-called "silk products" are manufactured by removing sericin which is a glue type protein from the silk yarns and weaving or knitting the sericin-removed silk yarns. It is deemed that the fibroin which is one of the components of silk product consists of a plurality of fibril molecules which are ester-bonded to each other. The silk products have various problems since the bond between the fibril molecules is weak. The silk fibers as natural material have not been scientifically researched completely and has a number of various unknown subjects.

The same applies to cellulose fibers (including cellulose fiber yarns) which are also manufactured from natural materials.

The present invention enhances shrink and crease resistance and shape stability of the silk yarn, cellulose fibers and their twisted yarns of their conjugate fibers by treating and finishing them using a sericin fixing method to form a skeleton of triazine or triazine bond in the fibers. Now, the properties of woven or knitted fabrics made from the inventive yarns and fibers will be shown.

There have been proposed various finishing and treating processes for conducting a method of fixing the sericin of the raw silk. A number of various solvents have been developed for these processes. However, the sericin which is a glue like protein provides hard touch and low gloss. If the raw silk is dyed, the sericin would be dissolved, resulting in that it will become hard to use the raw silk as garment fibers.

Accordingly, use of the sericin fixed type raw silk is limited to only special fabrics referred to as "kiginu" (unscoured silk) such as fabrics of silk organsee, chiffon, bolting cloth, Fuji silk. They have appearance, touch and characteristics which are different from those of the woven or knitted fabrics made from fibroin silk in which the sericin has been removed by dissolution.

Some of the sericin fixing methods use the materials as follows:

1. aldehydes
   formalin, glutaric aldehyde, dialdehyde starch, acrylic aldehyde
2. heavy metal salts
   chrome alum, dichromic acid salts+reducing agent, aluminum alum, acrylic aldehyde
3. tannin
4. synthetic resins melamines, DMNFU, epoxides
5. cyanuric chloride and dichlorotriazine type reactive dyes It has heretofore been proved that the methods using formalin, glutaric aldelhydes, chrome salts, and cyanutic chloride and dichlorotriazine type reactive dyes of the above-mentioned sericin fixing methods are most practical.

However, the method using formalin is not preferred since formalin gives a strong influence upon human body so that it is harmful. The method using chrome salts may cause environmental pollution by its industrial wastes and epoxide resins has problems that its working is unstable and it has a fear of influence to human body such as skin disease. Therefore, the foregoing method are not the best way.

The present invention adopts a sericin fixing method relying on formation of a skeleton triazine of cyanuric chlorides which do not have the above-mentioned problems.

It has been proved that the sericin will react with fibroin protein in an efficient manner in a method of forming skeleton triazine. It is deemed that the skeleton triazine in the sericin fixing method is represented by following chemical structures (refer to Japanese Examined Patent Publication No. Tokkosho 40-8050).

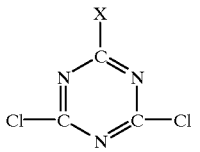

dichlorotriazine type reactive dye

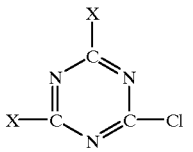

monochlorotriazine type reactive dye

An invention which is disclosed in Japanese Patent No. 2559302 (Japanese Unexamined Patent Publication No. Tokkaihei 4-300359) is an improvement in the invention of the Japanese Examined Patent Publication No. Tokkosho 40-8050).

In brief, the invention disclosed in the Japanese Examined Patent Publication No. Tokkosho 40-8050 proposes a sericin fixing method for fixing sericin in raw silk so that the sericin will not be dissolved in usual scouring (using hot water), soap scouring and alkaline scouring. The invention of Japanese Patent No. 2559302 proposes a method of finishing fibroin (silk) in which sericin has been removed.

A sericin fixing method using a reactive dye of cyanuric acid salt (cyanurate) or its derivatives or cyanuric acid derivatives is disclosed in Japanese Examined Patent Publication No. Tokkosho 40-8050. As mentioned above, the silk fabrics and silk fibers are covered on their surface thereof with sericin. The sericin shall be dissolved from the silk fabrics on soap or alkaline scouring if they have not been subjected to the sericin fixing method. However, specific fabrics, organsee or ornamental fabrics are preferably used while touch of the cloth is hard. Accordingly, it is necessary to fix the sericin so that it is hard to be dissolved on soap and alkaline scouring. National Institute of Agricultural Science of Sericultural and Insects, Ministry of Agricultural and Forestry has conducted research and development of materials having unique feeling relying on the characteristics of the sericin fixed fabrics and made a report on characteristics of their materials (refer to 47th Nissan Kanto, 1996, pages 82 to 83). The report says that fabrics were made by using mono-and dichlorotriazine type reactive dyes and various their characteristics were measured. Regarding the result of crease resistance, the recovery ratio of crease becomes low as the residual degree of the sericin becomes high.

The above-mentioned Japanese Examined Patent Publication No. Tokkosho 40-8050 was cited as a reference in the course of examination of the Japanese patent No. 2559302 entitled "composition for modifying of silk products and processes for the modification". In this invention, the object to be modified is defined as piece dyed type silk products which are dyed after removing sericin, that is the silk products made of only fibroin. The reason why the process of this invention is restricted to the piece dyed type silk products in order to avoid the problem inhering to the inventive product of the Japanese Examined Patent Publication No. Tokkosho 40-8050 is deemed as follows: In order to form a skeleton triazine, sericin fixing is conducted by applying 1% by weight of cyanuric chloride to the raw silk and using ethylenetetrachloride as a solvent.

However, cold water can not be used since cyanuric chloride is insoluble to the cold water. Ethylenetetrachloride, 1:1:2:2. tetrachloro-ethane and the like may be used as its solvent. Their derivatives are hard to be used since they have irritating odor like chloroform. It has been found that fixing of sericin for raw silk makes the sericin insoluble on usual soap and alkaline scouring. The fact that the recovery power of the crease is less if the sericin is not sufficiently dissolved so that it remains has been proved as mentioned above. Accordingly, the invention of the Japanese Patent No. 2559302 modifies by the cross linking reaction with fibroin the rubbing which occurs in thee course of manufacturing of the silk fabric made of only fibroin, in which sericin is dissolved out on usual soap and alkaline scouring.

SUMMARY OF THE INVENTION

The present invention was made to overcome the above-mentioned problems of the prior art. It is an object of the present invention to provide a process for manufacturing woven or knitted fabrics comprising the steps of modifying the woven or knitted fabrics by applying a skeleton triazine cross-linking reaction using a sericin fixing method of raw silk to enhance its shrink and crease resistance and shape stability and thereafter removing the sericin using a special scouring.

In other words, it is impossible to dissolve by an ordinary scouring, 100% sericin from the woven or knitted fabrics which are modified by the sericin fixing method. Accordingly, an inventive special scouring method including swelling and enzyme scouring steps which has been developed by the present inventor and was disclosed in Japanese Patent Application (Japanese Patent Application No. Hei 8-61825 relevant to International Patent Application PCT/JP/96/01019) is adopted for dissolving sericin.

In a first aspect of the present invention, there is provided a process for manufacturing a woven or knitted fabric, comprising the steps of: finishing and treating raw silk and/or cellulose fibers by using a silk sericin fixing method; doubling and twisting the finished and treated raw silk and/or cellulose fibers; weaving or knitting the doubled and twisted yarns to produce a fabric; swelling the woven or knitted fabric forming a cloth by dipping it in a bath; and scouring the woven or knitted fabric swelled in the bath with an enzyme whereby the woven or knitted fabric is provided with shrink and crease resistance and shape stability.

Prior to weaving or knitting, the silk sericin fixing method is conducted for raw silk and/or cellulose fibers. This enables the yarns to be hard-twisted in the doubling and twisting step so that the woven or knitted fabrics are provided with excellent resistant to shrink and crease and shape stability. The characteristics inherent in the silk are developed by removing the sericin except for part (or very thin layer) of sericin from the woven or knitted fabrics by a special scouring including swelling and enzyme-scouring steps developed by the present inventor for substantially exposing the fibroin portions. On the other hand, part (or very thin layer) of sericin of the woven or knitted fabrics remains around the fibroin portions to maintain excellent resistance to shrink and crease and shape stability.

The invention as defined in Claim 2 is characterized in that it includes a step of dyeing raw silk or cellulose fibers prior to said weaving or knitting step.

The invention as defined in Claim 3 characterized in that said finishing and treating step using the sericin fixing method is conducted with a reactive dye of cyanurate, its derivatives or cyanuric acid derivatives.

The invention as defined in Claim 4 is characterized in that it includes finishing step for washing out the enzyme deposited on the woven or knitted fabric after the step of scouring with the enzyme and in which softening and water repelling treatments are simultaneously conducted in the finishing step.

The invention as defined in Claim 5 is characterized in that it includes a step of dyeing the scoured woven or knitted fabric after the step of scouring with the enzyme.

In a second aspect of the present invention, there are provided woven or knitted fabrics which are manufactured by a process for manufacturing woven or knitted fabrics as defined in any one of the above-mentioned Claims.

The invention in a third aspect is characterized in that the yarns are finished and treated by the sericin fixing method after weaving or knitting whereas the yarns are finished and treated by the sericin fixing method before weaving or knitting in a first aspect of the invention.

In a fourth aspect of the present invention, there is provided woven or knitted fabrics which are manufactured by a process for manufacturing woven or knitted fabrics in a third aspect of the invention.

The invention in a fifth aspect is characterized in that conjugate twisted yarns of raw silk and cellulose filbers are used as either warps or wefts, or both whereas raw silk and/or cellulose fibers are used in the first aspect of the invention.

In a sixth aspect of the present invention, there are provided woven or knitted fabrics which are manufactured by a process for manufacturing woven or knitted fabrics in a fifth aspect of the invention.

BEST MODES OF EMBODYING INVENTION

A process for manufacturing woven or knitted fabrics having excellent shrink and crease resistance and shape stability using sericin fixed raw silk, cellulose fibers and their conjugate doubled and/or twisted yarns in accordance with the present invention and woven or knitted fabrics which are manufactured by the same process will be described in detail.

Figure 1:
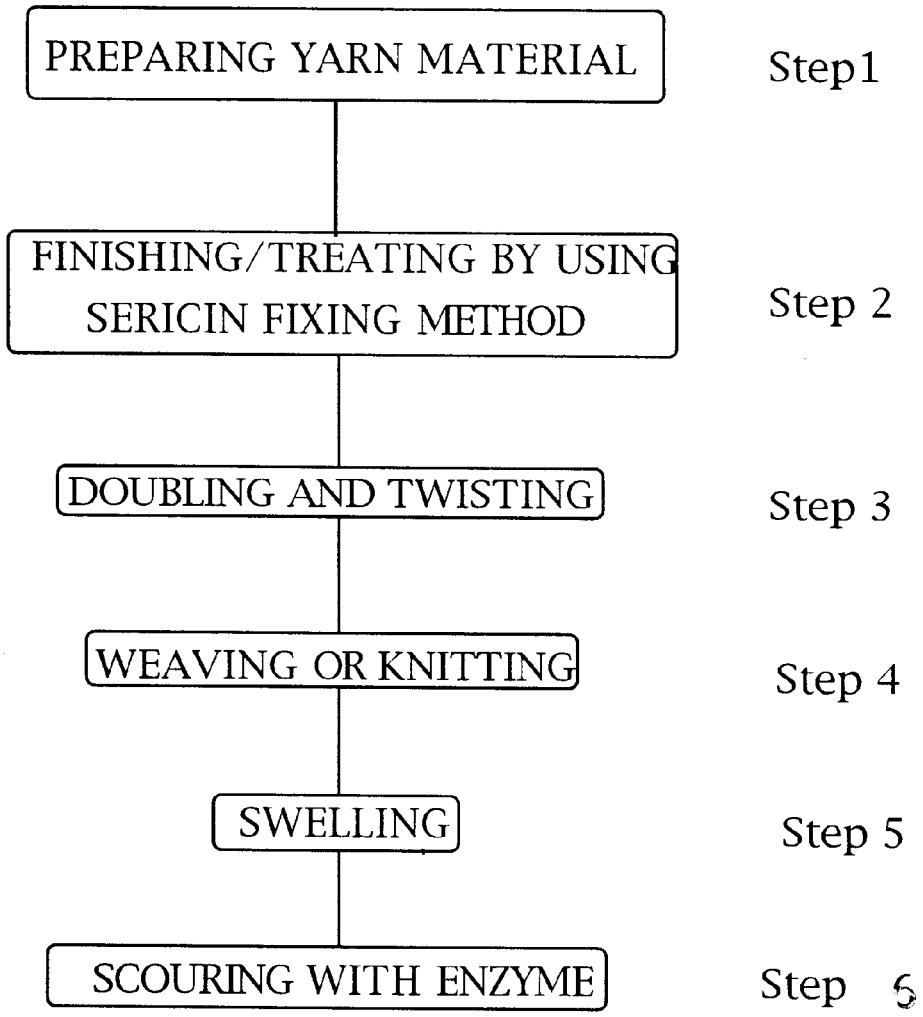
FIG. 1 is a flow chart showing an embodiment of a process for manufacturing woven or knitted fabrics in accordance with the present invention.

As shown in FIG. 1, the process for manufacturing the woven or knitted fabrics in accordance with the present invention essentially comprises the steps of: preparing yarn materials (step 1), finishing and treating the yarns using a sericin fixing method (step 2), doubling and/or twisting the yarns (step 3), weaving or knitting the yarns (step 4), swelling the woven or knitted fabrics (step 5) and scouring the woven or knitted fabrics with an enzyme (step 6).

The yarn materials may include raw silk, cellulose fibers and twisted conjugate yarns thereof. The yarn materials are finished and treated by a sericin fixing method. The sericin fixing method includes various methods as mentioned above. Methods using reactive dye such as cyanurate and its derivatives or cyanuric acid derivatives which are used in Japanese examined Patent. Publication No. Tokkosho 40-8050 and Japanese Patent No. 2559302 are preferable.

The raw silk and/or cellulose fibers which are finished and treated by the sericin fixing method are subjected to doubling and twisting. For example, the raw silk has an advantage that its yarns can be hard twisted since sericin is fixed to the periphery of fibroin portion of the raw silk. These doubled and/or twisted yarns are used as wefts and/or warps, figuring yarns so that they are woven or knitted. Accordingly, the woven or knitted fabrics have excellent shrink and crease resistance and shape stability.

The woven or knitted fabrics in this condition are stiff and have no gloss and flexibility which is inherent in silk since they have sericin which is fixed to the surface of the fibroin core. Therefore, in order to remove sericin, a special scouring process including swelling and enzyme scouring steps, which has been developed by the present inventor is performed so that the fibroin portion is substantially exposed by removing sericin excepting some (or very thin layer) of the sericin of the woven or knitted fabrics. On the other hand, some (or very thin layer) of sericin of the woven or knitted fabrics remains on the periphery of the fibroin portion for maintaining excellent shrink and crease resistance and shape stability of the woven or knitted fabrics.

Dyeing step can be performed prior to weaving or knitting step (step 4), preferably simultaneously with the sericin fixing method of step 2. This is due to the fact that dyeing can be finished in an even and beautiful manner if dyeing is performed after sericin fixing. Instead of or in addition to the yarn dyeing prior to the weaving or knitting, a step of dyeing of the scoured woven or knitted fabrics can be performed after step 6 of enzyme scouring. Since the sericin which is located on the face and reverse sides of the woven or knitted fabrics has been substantially removed from the periphery of the fibroin portion, there is an advantage that the woven or knitted fabrics can be dyed in a beautiful manner.

A finishing scoring step for washing out the enzyme deposited on the woven or knitted fabrics may be performed after the step 6 of enzyme scouring. Softening and water-repelling treatment may be preferably conducted in combination fifth and in this finishing scouring step.

Figure 2:
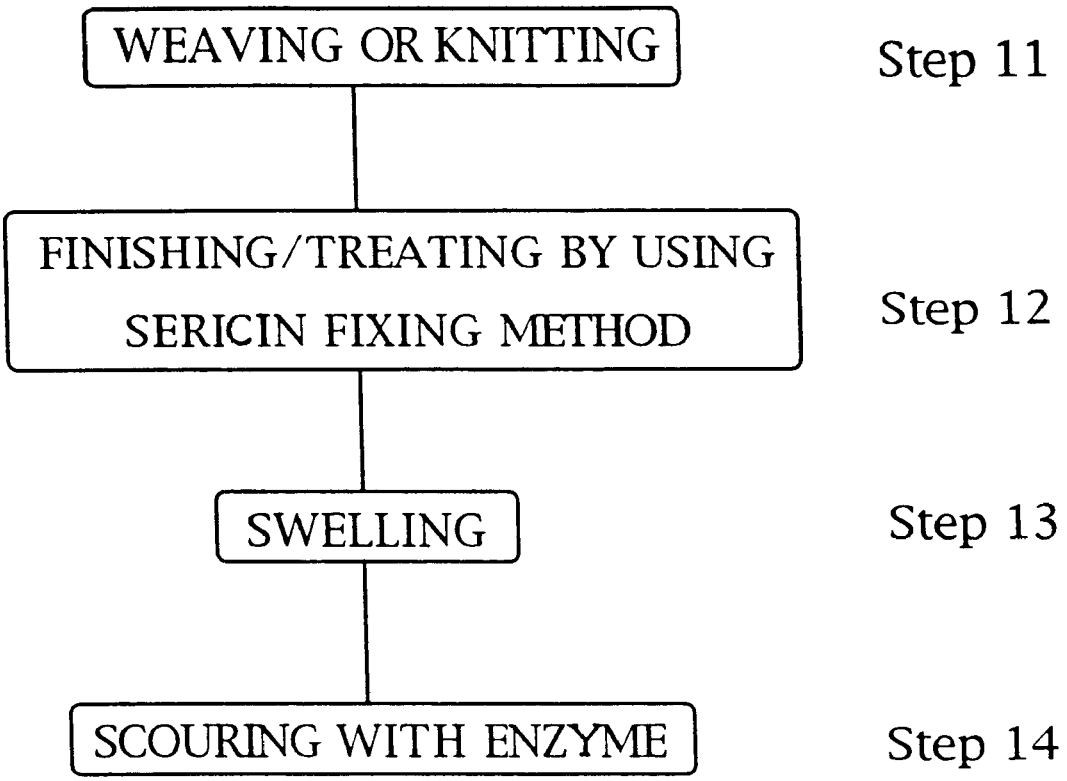
FIG. 2 is a flow chart showing another embodiment of a process for manufacturing woven or knitted fabrics in accordance with the present invention.

Now, a process for manufacturing woven for knitted fabrics which is a third embodiment of the present invention will be described with reference to FIG. 2.

The feature of the present invention resides in that finishing and treatment is performed by using the sericin fixing method after the yarns are woven or knitted into the fabrics whereas that of the above mentioned invention which is a first embodiment resides in that the yarns are finished and treated by using the sericin fixing method before weaving or knitting. In brief, the process for manufacturing the woven or knitted fabrics in accordance with this embodiment essentially comprises steps of weaving and knitting (step 11), finishing and treating by using the sericin fixing method (step 12), swelling the fabrics (step 13) and scouring the woven or knitted fabrics with an enzyme (step 14).

The woven or knitted fabrics are produced by using raw silk or cellulose fibers, or conjugate doubled and twisted yarns thereof and by being subjected to conventionally well known steps such as soaking, drying, winding, first twisting, doubling and twisting, and final twisting and setting. The woven or knitted fabrics are finished and treated by using the sericin fixing method of raw silk. The steps of finishing, treating, swelling of the fabrics, scouring with enzyme, dyeing and finishing scouring may be identical with those of the above-mentioned first embodiment.

EXAMPLES AND COMPARATIVE EXAMPLES

Raw silk and doubled and twisted composite yarns of raw silk and cellulose fibers were prepared (step 1).

a) 31D/2 raw silk yarns;
   2 (Z 1800 t/m) hard twisted yarns (S 1800 t/m)
b) 31D/6 raw silk yarns;
   2(Z 1800 t/m)×3 (S 600 t/m) folded yarns
c) 21D)/6 raw silk yarns;
   2 SZ (600 t/m)×3 ground yarns SZ 21D (2800 t/m)
d) 21D/3 raw silk yarns×SILMAX (rayon) 75D SZ 1600 t/m
e) 21D/3 raw silk yarn×Cupula (Benberg) 80D SZ 1600 t/m The yarns a) to d) were reeled in the form of hank, cone or cheese.

The twisted and reeled yarns were dipped into a bath so that they were subjected to the sericin fixing (step 2).

On the other hand, the yarns a), d) and e) were warped.

Since the fibroin silk yarns in which sericin has been dissolved have weak hydrogen bonds between fibrils, the fibril is liable to be separated to cause separation of fibers when the fibroin silk yarns are subjected to abrasion. Thus, high speed weaving can not be conducted.

Therefore, the yarns were doubled and twisted while protecting fibroin by using the sericin fixing method in accordance with the inventive process for manufacturing the woven or knitted fabrics (step 3), and high speed weaving was conducted while avoiding the cause of rub marks. Once the sericin fixing method was performed, sericin could not be dissolved by usual soap or alkali scouring. Accordingly, sericin was dissolved by the special scouring method including the swelling step (step 5) and enzyme scouring step (step 6), which was developed by the present inventor. At step 5, the fabrics were swelled to increase the volume of the yarns by dipping the fabrics in alkaline sodium bicarbonate (hot water in which a solvent such as RASEN POWER I, II was dissolved). At step 6, the cloth was treated with a sericin decomposable enzyme such as ALCALAZE and SEARIASE to remove sericin and thereafter finishing scouring was conducted.

Figure 3:
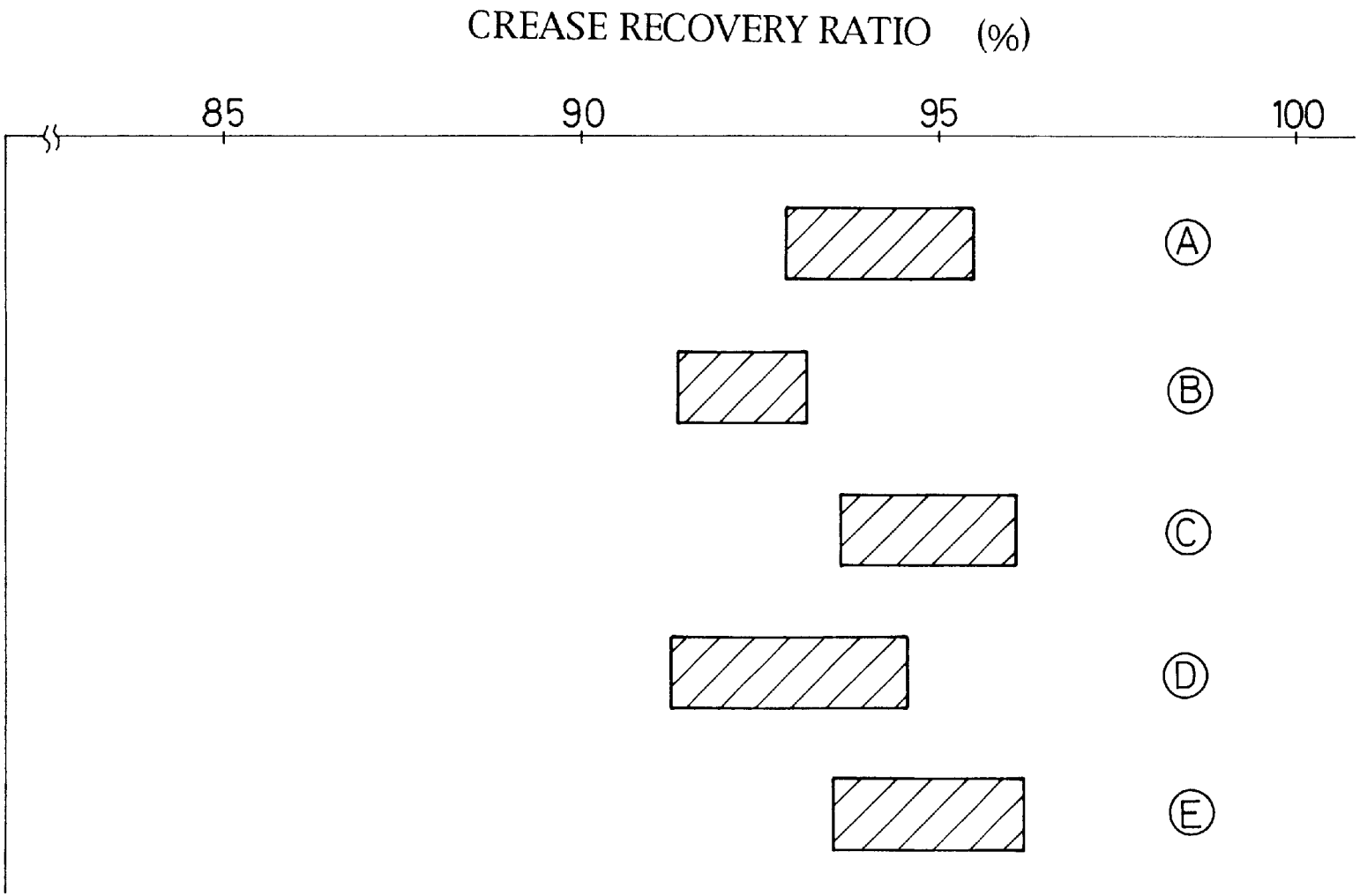
FIG. 3 is a graph showing the absolute values of crease recovery in a crease resistance test.
Figure 4:
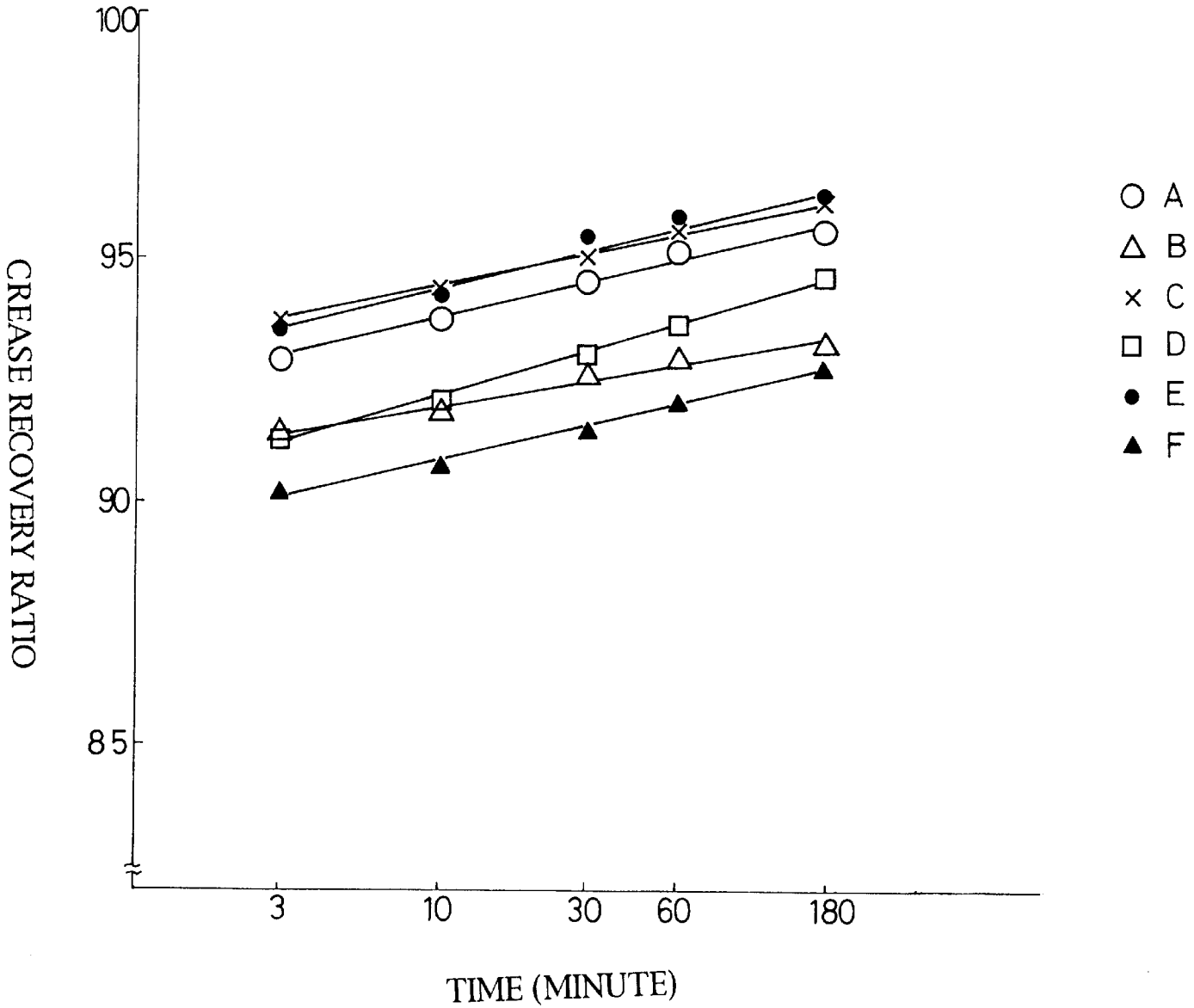
FIG. 4 is a graph showing changes in crease recovery with lapse of time.

Table 1 shows the result of shrinkage ratio tests which were conducted by Kyoto-fu Orimono Shidosho (Aza Tanba, Mineyama-machi, Naka-gun, Kyoto-fu/Tetsu Kobayashi in charge of test) for each of cloths as follows: FIGS. 3 and 4 show the absolute values and changes in crease recovery with lapse of time, respectively in the crease resistance test. The tests were conducted under following conditions.

1. The shrinkage ratio was measured in accordance with JIS L1042C.

2. Crease resistance test was conducted in accordance with JIS L1059D (Sanrei method).

Creasing conditions: temperature of 24° C., humidity of 70%, a period of one hour, load of 6 kg Recovery ratio was measured at 3, 10, 30, 60, 180 minutes after creasing.

The number of samples: 6

[A. warps 31D/2 hard twisted yarn(yarns to which sericin fixing treatment is not applied or sericin fixing untreated yarns);
wefts 31D)/6 folded yarns (sericin fixing untreated yarns);
21D/6 ground wefts (sericin fixing untreated yarns) satin of hard twisted yarn (special scouring, swelling, scouring with enzyme)]

B. warps 31D/2 hard twisted yarn (sericin fixing untreated yarns);
wefts 31D/6 folded yarns (sericin fixing untreated yarns);
21D/6 ground wefts (sericin fixing untreated yarns) satin of hard twisted yarns (ordinary soap or alkali scouring)

C. warps 31D/2 hard twisted yarns (sericin fixed untreated yarns);
wefts 31D/6 folded yarns (cyanurate, sericin fixed yarn);
21D/6 ground wefts (cyanurate, sericin fixed yarn) satin of hard twisted yarns (Special scouring; swelling and scouring with enzyme)

D. warps 31D/2 hard twisted yarns (sericin fixed untreated yarns);
wefts 31D/6 folded yarns (cyanurate, sericin fixed yarn);
21D/6 ground wefts (sericin fixed untreated yarns) satin of hard twisted yarns (Special scouring; swelling and scouring with enzyme)

E. same yarns as those of C (except for high pressure scouring)
(special Scouring; swelling and scouring with enzyme)

The above-mentioned yarns were woven at 126 rotation per minute by using a weaving machine (Jacquard) manufactured by Kabushiki-Kaisha Tsudakoma. The 31D/2 hard twisted yarns (sericin fixing untreated yarns) were commonly used as warps in all test. The results of shrinkage and crease tests show that the woven or knitted fabrics (samples C, D, E) which were produced by the present invention have shrink and crease resistance which are more excellent than those of the piece dyed fabric (sample B) to which usual soap or alkali scouring was conducted. It has been proved that excellent results were obtained by only conducting the sericin fixing method for wefts.

Figure 5:
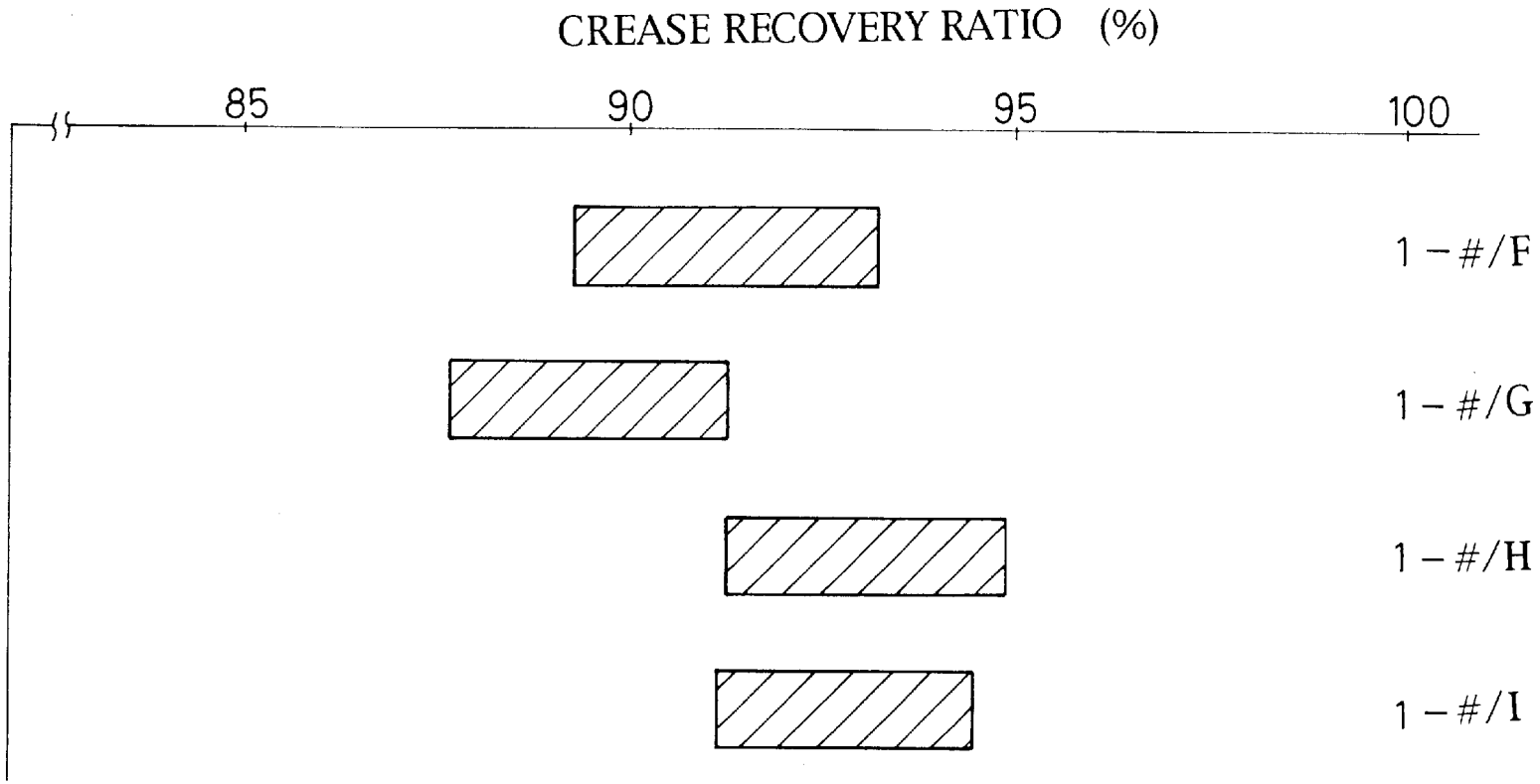
FIG. 5 is a graph showing the absolute values of crease recovery in a crease resistance test.
Figure 6:
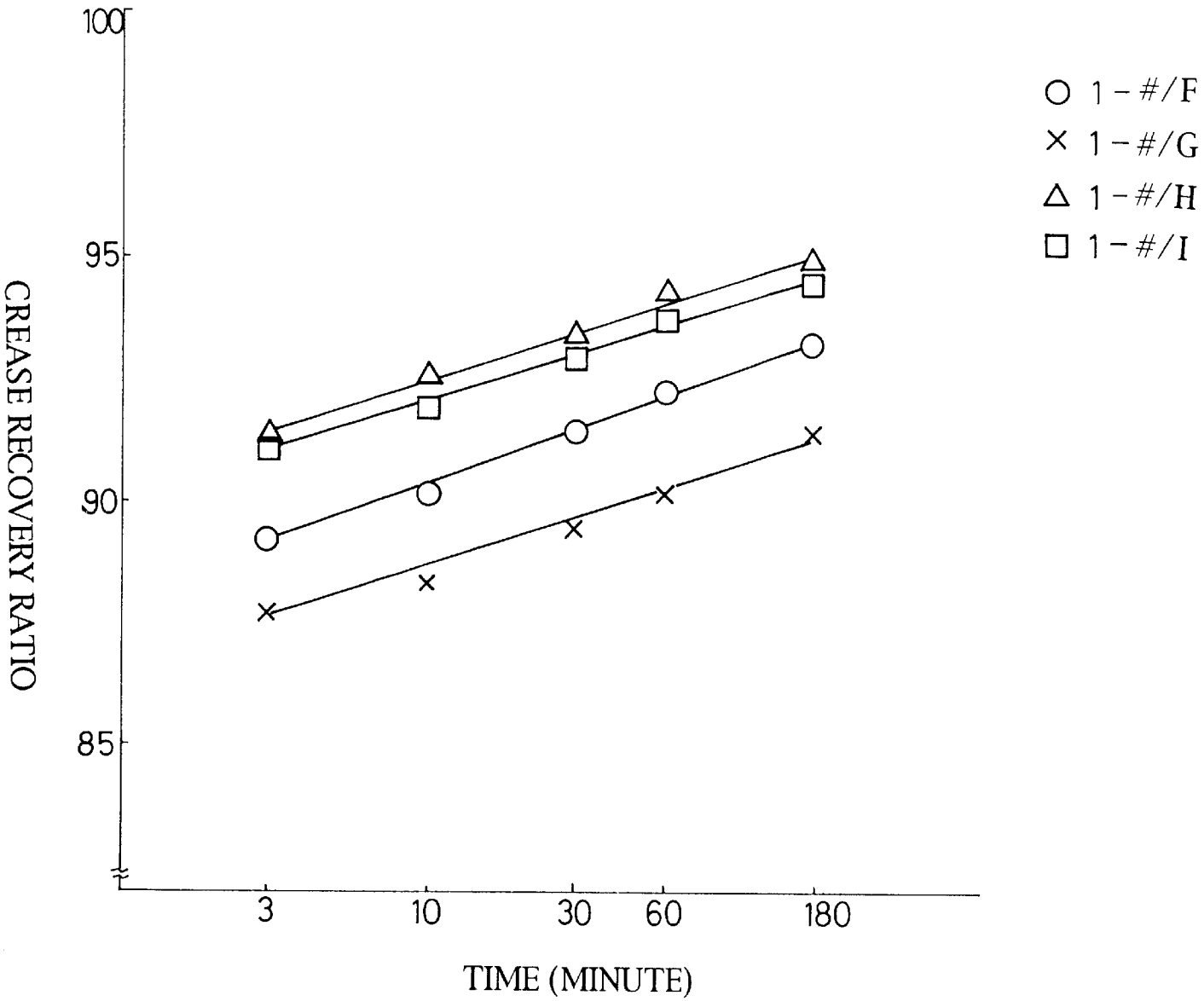
FIG. 6 is a graph showing changes in crease recovery rated with lapse of time.

Similarly, the degummed yarns in which sericin was reduced to 24% were prepared and satin of hard twisted degummed yarns was manufactured by weaving the yarns at 126 r.p.m. by a weaving machine (Jacquard) manufactured by Kabusiki Kaisha Thudakoma. Table 2 shows the result of the shrinkage ratio test which was conducted for each cloth. FIGS. 5 and 6 show the absolute values and changes in crease recovery with lapse of time, respectively in crease resistance test.

B. warps 31D/2 hard twisted degummed yarns (which are degummed and woven or knitted thereafter)
wefts 31D/6 folded yarns (sericin fixing untreated yarns);
21D/6 ground wefts (sericin fixing untreated yarns) (ordinary soap or alkali scouring)

A. warps 31D/2 hard twisted degummed yarns (which are degummed and woven or knitted thereafter)
wefts 31LD/6 folded yarns (which are degummed and woven or knitted thereafter); 21LD/6 ground wefts (sericin fixing untreated yarns) (ordinary soap or alkali scouring; high pressure scouring)

C warps 31D/2 hard twisted degummed yarns (which are degummed and woven or knitted thereafter) wefts 31D/6 folded yarns (sericin fixed yarns); 21D/6 ground wefts (sericin fixed yarns) (special scouring; swelling and enzyme scouring)

D. warps 31D/2 hard twisted degummed yarns (which are degummed and woven or knitted thereafter)
wefts 31D/6 folded yarns (which are degummed and woven or knitted thereafter); 21D/6 ground wefts (cyanurate; sericin fixed yarns) (special scouring; swelling and enzyme scouring)

The result shows that the cloth (sample A) which was manufactured using yarns which were warps of 31D/2 hard twisted degummed yarn and ground wefts of 31D/6 folded yarns has more excellent shrinkage ratio in comparison with that of conventional cloth (sample B). The crease recovery is remarkably inferior to that of B in Table 1.

However, if the wefts are subjected to the sericin fixing treatment by the process of the present invention, the creasing recovery ratio would exceed 91% so that it is remarkably improved.

Similarly, yarns of silk 21D/3×rayon (SILMAX, BRIGHT) 75D having 38% by weight of silk and 62% by weight of rayon in composition weight ratio were twisted at S.Z 1600 t/m and then warps were manufactured by conducting the sericin fixing treatment of the yarns in the form of cone. Silk woven W Georgette (sample A) was woven at 340 r.p.m. by a Dobby weaving machine (Picanor GT-S) under conditions of 40 dents (3 reeds)/inch, reed space of 68 inches; a total 8160 warps, and perching 84/inch.

Similarity, yarns of silk 21D/3×Cupula (Benberg) 40D×2 having 34% by weight of silk and 64% by weight of Cupula in composition weight ratio were twisted at S.Z 1600 t/m and then warps were manufactured by conducting the sericin fixing treatment of the yarns in the form of cone. Silk woven W Georgette (sample B) was woven at 340 r.p.m. by a Dobby weaving machine (Picanor GT-S) under conditions of 40 dents (3 reeds)/inch, reed space of 68 inches; a total 8160 warps, and perching 84/inch.

Figure 7:
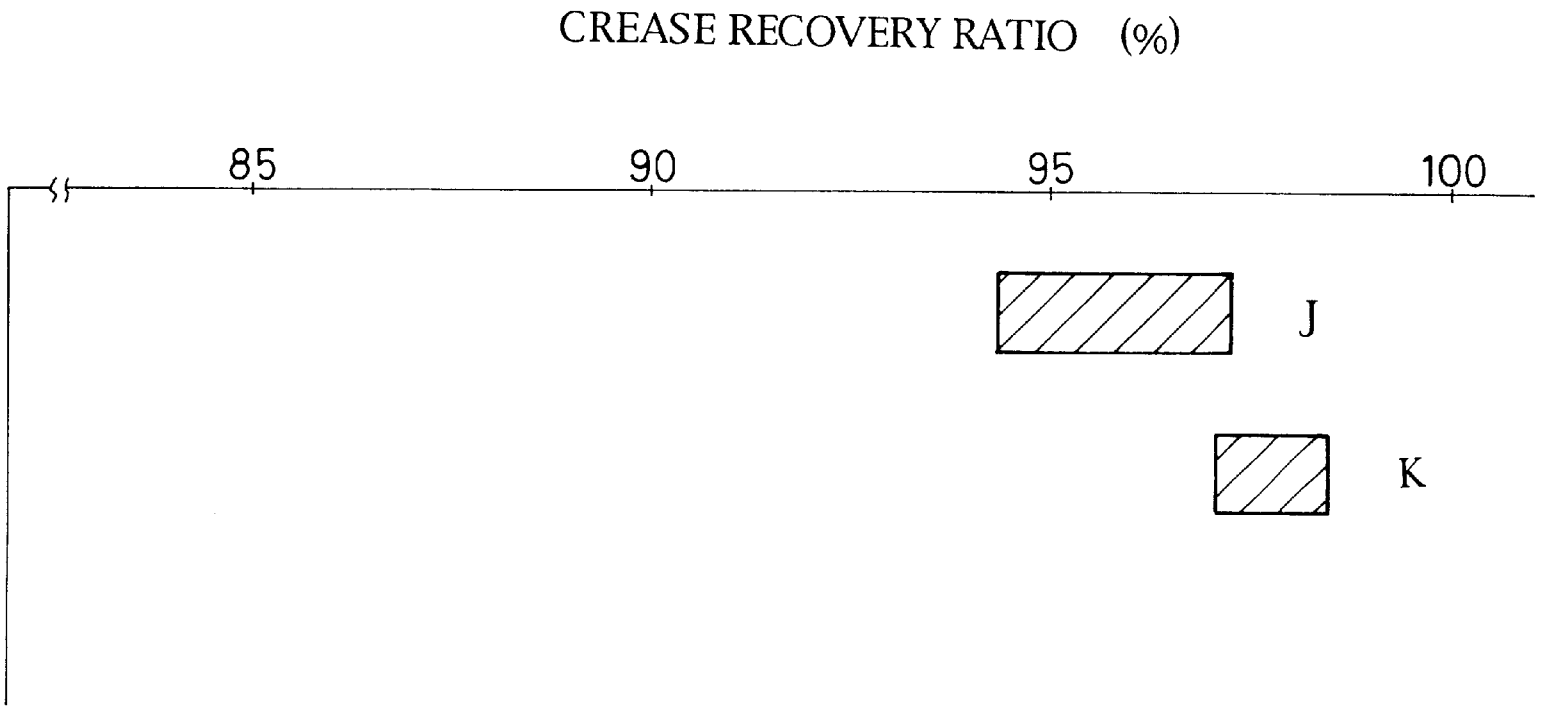
FIG. 7 is a graph showing the absolute values of crease recovery in a crease resistance test.
Figure 8:
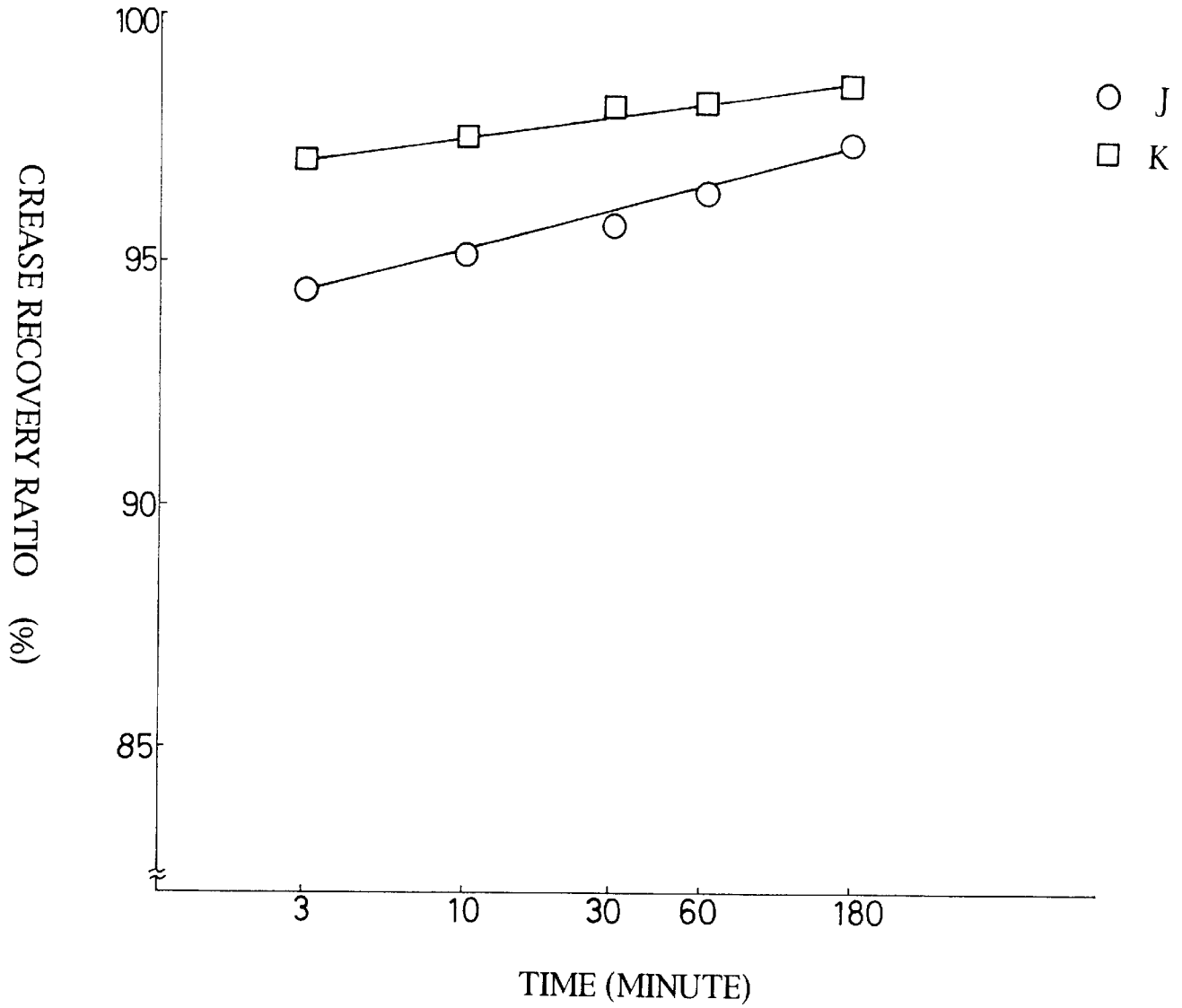
FIG. 8 is a graph showing changes in crease recovery with lapse of time.

These fabrics were treated by the special scouring method (swelling and scouring with enzyme). A test was conducted as is similarly to Tables 1 and 2. Table 3 shows the result of the shrinkage ratio test which was performed for each of the above-mentioned fabrics. FIGS. 7 and 8 show the absolute values and changes of the crease recovery with lapse of time, respectively.

The result shows that all fabrics made of cellulose fibers exhibit not so excellent shrinkage ratio in a longitudinal direction since hard twisted yarns are used while they exhibit remarkably high recovery ratio in the crease resistance test. This proves that formation of skeleton triazine is advantageous for silk as well as cellulose fibers.

Then, a fancy solid crepe fabric was made from the raw silk which will be described below. The sericin fixing method was performed for the woven fabric.

warps: raw silk of 27 Denier; 8,320 yarns (2,080 ×4) reed space of 40.5 cm wefts (ground wefts)

a. (1) 9 raw silk yarns of 21 Denier were twisted at 3,000 t/m in an S direction.

(2) 3 raw silk yarns of 21 Denier were twisted at 2,800 t/m in a Z direction and combined with one raw silk yarn of 27 Denier and twisted in an S direction.

The yarns of (1) and (2) were doubled and twisted at 400 t/m in a Z direction.

b. Similar reversely twisted yarns were manufactured. (figuring extra weft)

c. (1) 6 raw silk yarns of 21 Denier were twisted at 500 t/m in an S direction (1).

(2) 9 raw silk yarns of 21 Denier were twisted at 500 t/m in an S direction.

The yarns (1) and (2) were doubled and twisted at 400 t/m in a Z direction.

The thus manufactured wefts (a), (b), (c) were plain-woven such that Tango creep fabric (fancy solid crepe) was manufactured by weaving the ground wefts and figuring extra wefts in order of (a), (b), (c) and (b) by means of a Dobby weaving machine at 150 r.p.m.

A. The fancy solid crepe was subjected to a traditional soap or alkali scouring.

B. The fancy solid crepe fabric was subjected to the sericin fixing treatment.

(degumming of 10% by weight ratio) special scouring, swelling, and scouring with enzyme C. The fancy solid crepe fabric was subjected to the sericin fixing treatment.

(degumming of 20% by weight ratio) special scouring, swelling and scouring with enzyme D. The fancy solid crepe fabric was subjected to the sericin fixing treatment.

(degumming of 20% weight ratio) special scouring, swelling, and scouring with enzyme (high pressure scouring)

E. The ground wefts (c) described above of the fancy solid crepe fabric was subjected to cyanuric chloride and sericin fixing treatment.

warps: 4 warps were alternatingly subjected to cyanuric chloride (or sericin fixing) treatment.

wefts: ground wefts were subjected to the foregoing sericin fixing treatment.

Figuring extra wefts were subjected to the foregoing sericin fixing treatment.

special scouring, swelling and scouring with enzyme.

Figure 9:
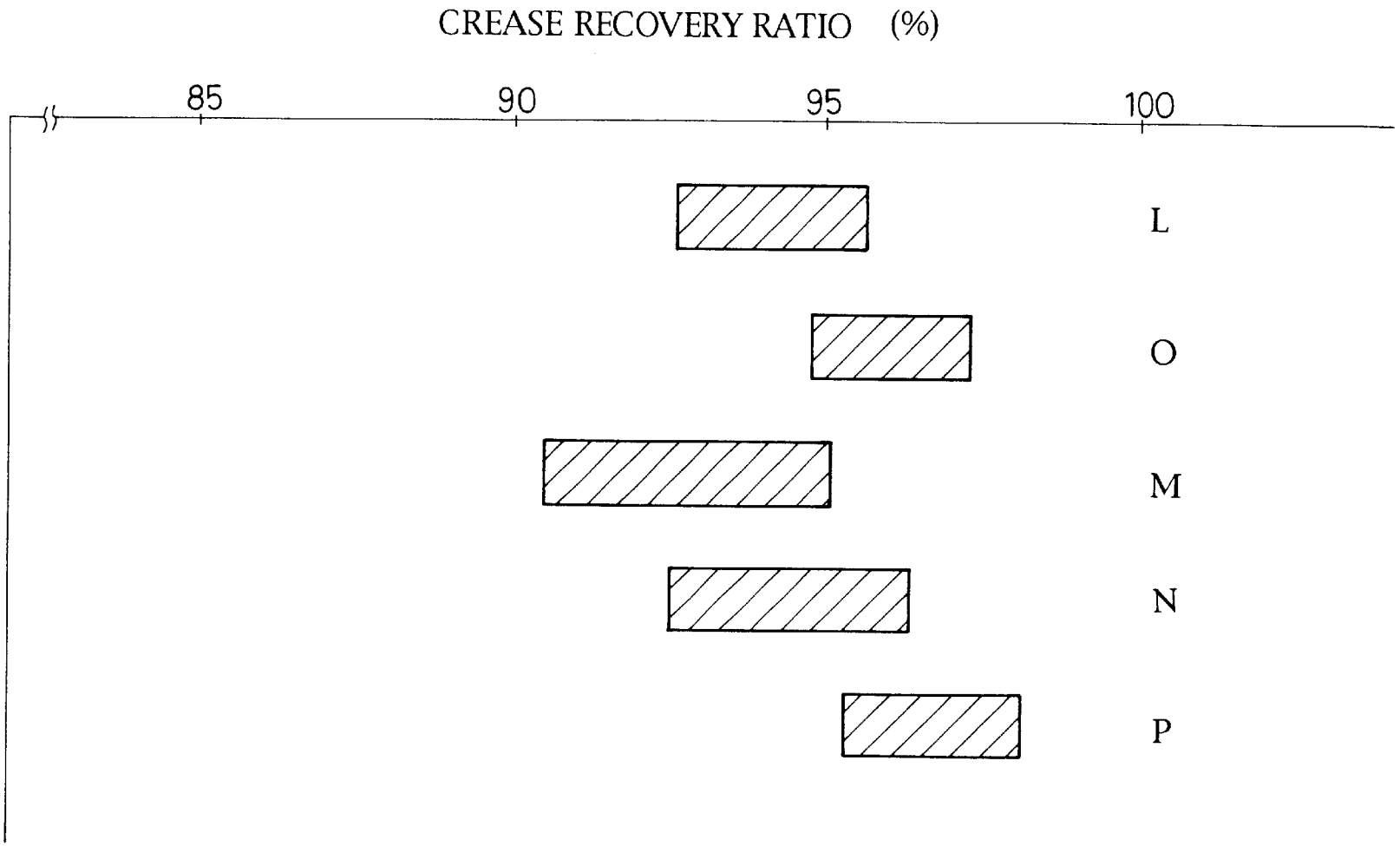
FIG. 9 is a graph showing the absolute values of crease recovery in a crease resistance test.
Figure 10:
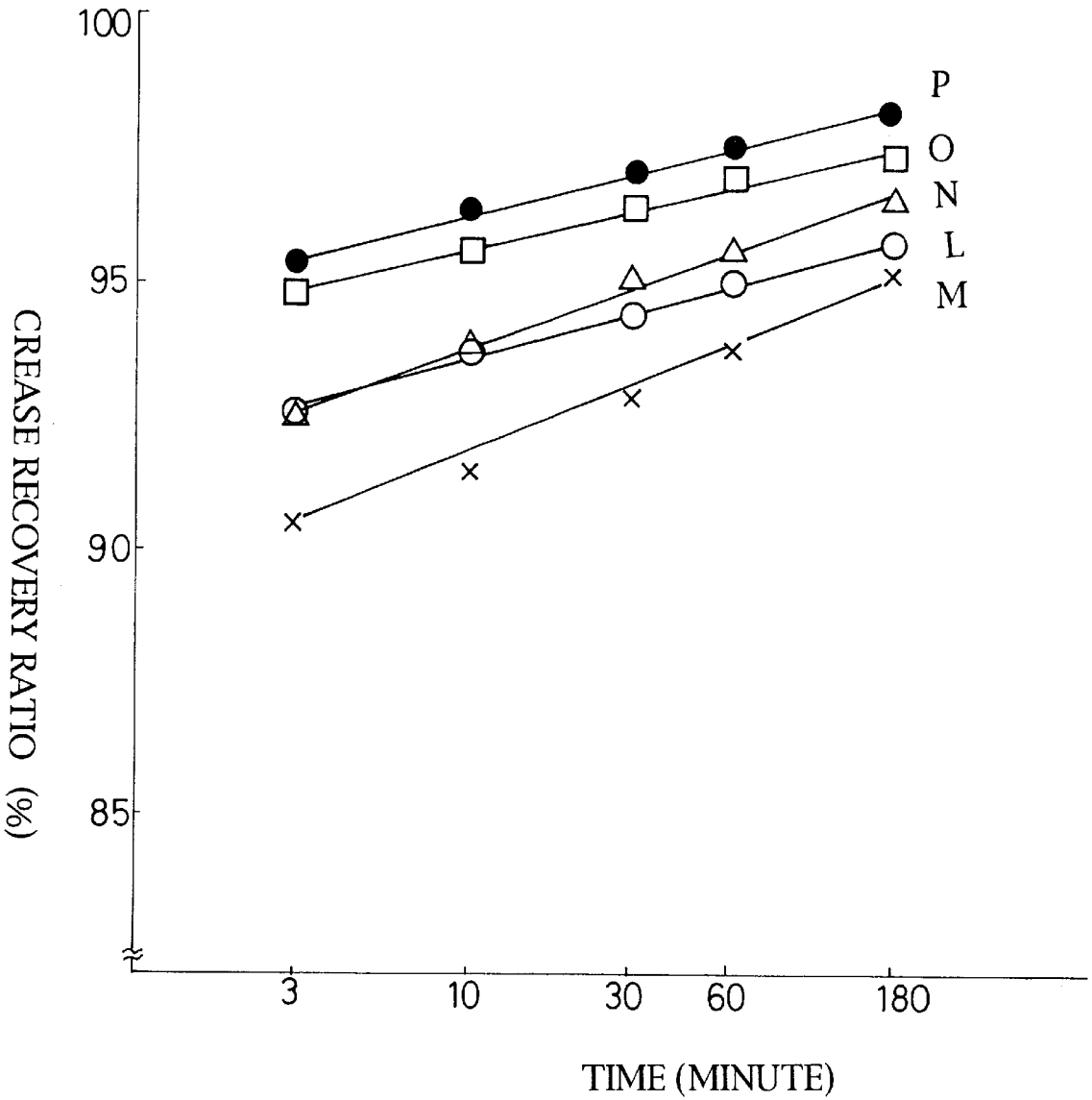
FIG. 10 is a graph showing changes in crease recovery rated with lapse of time.

Table 4 shows the result of shrinkage ratio test which was conducted for each of the clothes. FIGS. 9 and 10 show the absolute value and crease recovery ratio with lapse of time in the crease resistance test, respectively.

The conventional solid crepe has been manufactured through traditional various complicated steps for providing crimped and flexible (or drapable) kimono. Since traditional fabrics have been produced by dissolving sericin with soap or alkali scouring. On its crease recovery ability and shrink resistance has not been improved. However, it has been proved that the present inventive product in which the sericin fixing has been applied to cloth has an improved crease recovery ability, shrink resistance and shape stability.

Furthermore, a color fastness test of following fabrics was conducted.

A. A black formal wear which was dyed with a conventional direct dye after the conventional fancy solid crepe was scoured with soap or alkali.

B. Warps and wefts (figuring extra wefts) were subjected to the sericin fixing treatment (method) by using the cyanuric chloride. The above-mentioned conventional ground wefts were used as wefts. The yarns were subjected to special scouring, swelling and scouring with enzyme. The ground wefts were overlay-dyed with an acidic dye to provide a non color solid fabric.

C. Both warps and wefts were subjected to the sericin fixing treatment by the cyanuric chloride or sericin fixing method. Thereafter a reactive dye (Sumifix Block Ex gran) was used and weaving was conducted. A black formal wear which was subjected to a special scouring, swelling and scouring with enzyme was provided.

Tables 5 to 7 show the result of color fastness tests which were conducted for each of the fabrics.

The results prove that the fabrics which were subjected to the sericin fixing method exhibit an remarkably improved color fastness without deteriorating the characteristics of the silk and that the silk woven fabrics have a higher shape stability if they are subjected to dyeing with a reactive dye.

INDUSTRIAL UTILIZATION

It has been proved that the process for fixing the sericin of raw silk in accordance with the present invention enhances its shrink and crease resistance and shape stability.

Primarily, an object of the development of a new "kimono" product which meets the market need in the Japanese clothes resides in the development of new form of silk yarns. The disadvantage of the conventional Japanese clothes resides in that the silk products (kimono) which are degummed by traditional soap or alkali scouring, and are dyed thereafter do not have sufficient shrink and crease resistance and color fastness. Research of sericin fixed yarns is conducted in National Institute of Sericultural and Insects, Ministry of Agriculture and Forestry. The institute reports that the sericin fixed yarns have no problem in its stretch strength while the shape of the fabrics largely depend upon the degree of fixing of the sericin and the crease recovery is slow if the amount of the residual sericin is large.

It has been proved that a reaction of cross-linking to form a skeleton triazine, which is caused by the sericin fixing method of the present invention, enhances the shrink and crease resistance and shape stability of new form of yarns in combination with the special souring, or swelling and scouring with enzyme of the present invention.

Secondarily, it has been proved that the sericin fixing method is applicable to cellulose fibers as well as silk. The characteristics which both fibers possess are improved and enhanced.

Thirdly, process for finishing the new form of fabrics includes treatment with epoxy resin and urethane resin, and further includes shape memory treatment using formalin and ammonia and the like. However, these processes for finishing and treating the fabrics are not useful since they may give an adverse influence upon human body or cause destroy of global environment such as ozone layer. In contrast to this, skin application test which conducted for 20 persons shows that the fabrics which are manufactured by the present invention give no adverse influence upon human body (Refer to Skin application Test Report/Registered No.

13617-1 prepared by Nihon Sangyo Hifu Eisei Kyokai: Nishishichijo minanino-cho 60, Shimogyo-ku, Kyoto-shi).

Fourthly, it has been proved that the sericin fixing method is capable of improving and enhancing the resistance to the color change and fading and contamination. The present invention has a very high value in industrial utilization.

TABLE 1

| | LONGITUDINAL (%) | LATERAL (%) |
|---|---|---|
| [A | 7.8 | 0.6] |
| B | 6.3 | 0.8 |
| C | 8.5 | 0.1 |
| D | 7.0 | 0.0 |
| E | 7.3 | 0.0 |

Values of A, B; C and D, E are averages of 9, 6 and 3 measurements, respectively.

TABLE 2

| | LONGITUDINAL (%) | LATERAL (%) |
|---|---|---|
| [1-#/A] | 3.7 | 0.9 |
| [1-#/B] | 4.0 | 0.5 |
| [1-#/C] | 4.2 | 0.3 |
| [1-#/D] | 4.5 | 0.9 |

Values are averages of 9 measurements.

TABLE 3

| | LONGITUDINAL (%) | LATERAL (%) |
|---|---|---|
| A | 10.6 | 1.3 |
| B | 5.7 | 2.5 |

Values are averages of 9 measurements

TABLE 4

| | LONGITUDINAL (%) | LATERAL (%) |
|---|---|---|
| A | 11.6 | 1.9 |
| B | 9.8 | 0.4 |
| C | 6.6 | 0.2 |
| D | 7.1 | 0.2 |
| E | 0.4 | 0.0 |

Values of A, D and B, C, E are averages of 9 and 6 measurements, respectively.

TABLE 5

| CARBON ARC LIGHT TEST (JIS L0842) | SECOND EXPOSURE METHOD |
|---|---|
| COLOR CHANGE AND FADING | 6TH GRADE |
| ABRASION TEST (JIS L0849) TEST MACHINE II TYPE | |
| (DRY) | 4TH TO 5TH GRADE |
| (WET) | 2ND TO 3RD GRADE |
| WASHING TEST (JIS L0844) | |
| * * * * * * * * * * * * | |
| DRY CLEANING (JIS L0840) | |
| COLOR CHANGE AND FADING | 4TH TO 5TH GRADE |
| CONTAMINATION | 3RD GRADE (COTTON) |
| HOT WATER TEST (JIS L0845) | |
| * * * * * * * * * * * * | |
| COLD WATER TEST (JIS L0846) | |

TABLE 5-continued

| * * * * * * * * * * * * | | |
|---|---|---|
| SWEAT TEST A METHOD (JIS L0848) | | |
| (ACID) | COLOR CHANGE AND FADING | 5TH GRADE |
| | CONTAMINATION | 3RD GRADE (SILK)<br>3RD GRADE (COTTON) |
| (ALKALI) | COLOR CHANGE AND FADING | 4TH TO 5TH GRADE |
| | CONTAMINATION | 1ST TO 2ND GRADE (SILK)<br>1ST TO 2ND GRADE (COTTON) |

TABLE 6

| CARBON ARC LIGHT TEST (JIS L0842) | SECOND EXPOSURE METHOD |
|---|---|
| COLOR CHANGE AND FADING | 4TH GRADE |
| ABRASION TEST (JIS L0849) TEST MACHINE II TYPE | |
| (DRY) | 5TH GRADE |
| (WET) | 5TH GRADE |
| WASHING TEST (JIS L0844) C-1S METHOD | |
| COLOR CHANGE AND FADING | 3RD GRADE |
| CONTAMINATION | 3RD TO 4TH GRADE (SILK)<br>5TH GRADE (COTTON) |
| DRY CLEANING (JIS L0840) | |
| COLOR CHANGE AND FADING | 5TH GRADE |
| CONTAMINATION | 3RD TO 4TH GRADE (NYLON) |
| HOT WATER TEST (JIS L0845) | |
| * * * * * * * * * * * * | |
| COLD WATER TEST (JIS L0846) | |
| COLOR CHANGE AND FADING | 3RD TO 4TH GRADE |
| CONTAMINATION | 2ND TO 3RD GRADE (SILK)<br>4TH GRADE (COTTON) |
| SWEAT TEST A METHOD (JIS L0848) | |
| (ACID) COLOR CHANGE AND FADING | 3RD TO 4TH GRADE |
| CONTAMINATION | 3RD GRADE (SILK)<br>5TH GRADE (COTTON) |
| (ALKALI) COLOR CHANGE AND FADING | 3RD TO 4TH GRADE |
| CONTAMINATION | 2ND TO 3RD GRADE (SILK)<br>4TH TO 5TH GRADE (COTTON) |

TABLE 7

| CARBON ARC LIGHT TEST (JIS L0842) | SECOND EXPOSURE METHOD |
|---|---|
| COLOR CHANGE AND FADING | 5TH TO 6TH GRADE |
| ABRASION TEST (JIS L0849) TEST MACHINE II TYPE | |
| (DRY) | 5TH GRADE |
| (WET) | 4TH TO 5TH GRADE |
| WASHING TEST (JIS L0844) | |
| * * * * * * * * * * * * | |
| DRY CLEANING (JIS L0840) | |
| COLOR CHANGE AND FADING | 4TH GRADE |

TABLE 7-continued

| | | |
|---|---|---|
| CONTAMINATION | | 3RD TO 4TH GRADE (NYLON) |
| HOT WATER TEST (JIS L0845) | | |
| * * * * * * * * * * * | | |
| COLD WATER TEST (JIS L0846) | | |
| * * * * * * * * * * * | | |
| SWEAT TEST A METHOD (JIS L0848) | | |
| (ACID) | COLOR CHANGE AND FADING | 5TH GRADE |
| | CONTAMINATION | 5TH GRADE (SILK)<br>5TH GRADE (COTTON) |
| (ALKALI) | COLOR CHANGE AND FADING | 5TH GRADE |
| | CONTAMINATION | 5TH GRADE (SILK)<br>5TH GRADE (COTTON) |

What is claimed is:

1. A process for manufacturing a woven or knitted fabric made of silk alone or as a component thereof, the silk comprising a fibroin core and sericin sheath therearound, comprising the steps of:

finishing and treating raw silk, or a composite of raw silk and cellulose fibers, for fixing the sericin sheath around the fibroin core by using a silk sericin fixing method in which a skeleton triazine cross-linking is formed between the sericin sheath and the fibroin core;

doubling and twisting the finished and treated raw silk or the composite of raw silk and cellulose fibers to produce yarns;

weaving or knitting the doubled and twisting yarns to produce a fabric;

swelling the woven or knitted fabric forming a cloth by dipping it in a bath; and scouring the woven or knitted fabric swelled in the bath with an enzyme whereby the woven or knitted fabric is provided with shrink and crease resistance and shape stability.

2. A process for manufacturing a woven or knitted fabric as defined in claim 1 further including a step of dyeing raw silk or the composite of raw silk and cellulose fibers prior to said weaving or knitting step.

3. A process for manufacturing a woven or knitted fabric as defined in claim 1 in which said finishing and treating step using the sericin fixing method is conducted with a reactive dye of cyanurate, its derivatives or cyanuric acid derivatives.

4. A process for manufacturing a woven or knitted fabric as defined in claim 1 further including a finishing step for washing said enzyme deposited on the woven or knitted fabric after the step of scouring with said enzyme and in which softening and water repelling treatments are simultaneously conducted in the finishing step.

5. A process for manufacturing a woven or knitted fabric as defined in claim 1 and further including a step of dyeing the scoured woven or knitted fabric after the step of scouring with the enzyme.

6. A process for manufacturing a woven or knitted fabric as defined in claim 2 and further including a step of dyeing the scoured woven or knitted fabric after the step of scouring with the enzyme.

7. A woven or knitted fabric which is manufactured by a process as defined in claim 1.

8. A process for manufacturing a woven or knitted fabric, made of silk alone or as a component thereof, the silk comprising a fibroin core and sericin sheath therearound, comprising the steps of:

weaving or knitting raw silk or composite of raw silk and cellulose fibers to produce a fabric;

finishing and treating the woven or knitted fabric by using a silk sericin fixing method in which a skeleton triazine cross-linking is formed between the sericin and the fibroin core;

swelling the woven or knitted fabric forming a cloth by dipping it in a bath; and scouring the woven or knitted fabric swelled in the bath with an enzyme whereby the woven or knitted fabric is provided with shrink and crease resistance and shape stability.

9. A process for manufacturing a woven or knitted fabric as defined in claim 8 and in which the raw silk or cellulose fibers have been previously dyed to a desired color.

10. A process for manufacturing a woven or knitted fabric as defined in claim 8 in which said finishing and treating step using the sericin fixing method is conducted with a reactive dye of cyanurate, its derivative or cyanuric acid derivative.

11. A process for manufacturing a woven or knitted fabric as defined in claim 8 further including a finishing step for washing out said enzyme deposited on the woven or knitted fabric after the step of scouring with said enzyme and in which softening and water repelling treatments are simultaneously conducted in the finishing step.

12. A process for manufacturing a woven or knitted fabric as defined in claim 8 and further including a step of dyeing the scoured woven or knitted fabric after the step of scouring with the enzyme.

13. A process for manufacturing a woven or knitted fabric as defined in claim 9 and further including a step of dyeing the scoured woven or knitted fabric after said step of scouring with the enzyme.

14. A woven or knitted fabric which is manufactured by a process as defined in claim 8.

15. A process for manufacturing a woven or knitted fabric, made of silk as a component thereof, the silk comprising a fibroin core and sericin sheath therearound, comprising the steps of:

finishing and treating conjugate twisted yarns of raw silk and cellulose fibers by using a silk sericin fixing method in which a skeleton triazine cross-linking is formed between the sericin sheath and the fibroin core;

doubling and twisting the finished and treated yarns;

weaving or knitting the doubled and twisted yarns as either warps or wefts, or both to produce a fabric;

swelling the woven or knitted fabric forming a cloth by dipping it in a bath; and scouring the woven or knitted fabric swelled in the bath with an enzyme for decomposing the sericin whereby the woven or knitted fabric is provided with shrink and crease resistance and shape stability.

16. A process for manufacturing a woven or knitted fabric as defined in claim 15 and further including a step of dyeing raw silk or cellulose fibers prior to said weaving or knitting step.

17. A process for manufacturing a woven or knitted fabric as defined in claim 15 in which said finishing and treating step using the sericin fixing method is conducted with a reactive dye of cyanurate, its derivatives or cyanuric acid derivatives.

18. A process for manufacturing a woven or knitted fabric as defined in claim 15 further including a finishing step for washing out said enzyme deposited on the woven or knitted fabric after the step of scouring with said enzyme and in which softening and water repelling treatments are simultaneously conducted in the finishing step.

19. A process for manufacturing a woven or knitted fabric as defined in claim 15 and further including a step of dyeing the scoured woven or knitted fabric after the step of scouring with the enzyme.

20. A process for manufacturing a woven or knitted fabric as defined in claim 16 and further including a step of dyeing the scoured woven or knitted fabric after the step of scouring with the enzyme.

21. A woven or knitted fabric which is manufactured by a process as defined in claim 15 through.

22. A process for manufacturing a woven or knitted fabric, made of silk as a component thereof, the silk comprising a fibroin core and sericin sheath therearound, comprising the steps of:

weaving or knitting conjugate twisted yarns of raw silk and cellulose fibers as either warps or wefts, or both to produce a fabric;

finishing and treating the woven or knitted fabric by using a silk sericin fixing method in which a skeleton triazine cross-linking is formed between the sericin sheath and the fibroin core;

swelling the woven or knitted fabric forming a cloth by dipping it an a bath; and scouring the woven or knitted fabric swelled in the bath with an enzyme whereby the woven or knitted fabric is provided with shrink and crease and shape stability.

23. A process for manufacturing a woven or knitted fabric as defined in claim 22 in which the conjugate twisted yarns have been previously dyed to a desired color.

24. A process for manufacturing a woven or knitted fabric as defined in claim 22 in which said finishing and treating step using the sericin fixing method is conducted with a reactive dye of cyanurate, its derivatives or cyanuric acid derivatives.

25. A process for manufacturing a woven or knitted fabric as defined in claim 22 further including a finishing step for washing out said enzyme deposited on the woven or knitted fabric after the step of scouring with said enzyme and in which softening and water repelling treatments are simultaneously washing step.

26. A process for manufacturing a woven or knitted fabric as defined in claim 22 and further including a step of dyeing the scoured woven or knitted fabric after the step of scouring with the enzyme.

27. A process for manufacturing a woven or knitted fabric as defined in claim 23 and further including a step of dyeing the scoured woven or knitted fabric after the step of scouring with the enzyme.

28. A woven or knitted fabric which is manufactured by a process as defined in claim 22.

29. A process for manufacturing a woven or knitted fabric as defined in claim 1 in which said finishing and treating steps using the sericin fixing method is conducted with a cyanuric chloride, cyanurate, its derivatives or cyanuric acid derivatives.

30. A process for manufacturing a woven or knitted fabric as defined in claim 8 in which said finishing and treated step using the sericin fixing method conducted with a cyanuric chloride, cyanurate, its derivatives or cyanuric acid derivatives.

31. A process for manufacturing a woven or knitted fabric as defined in claim 15 in which said finishing and treating step using the sericin fixing method is conducted with a cyanuric chloride, cyanurate, its derivatives or cyanuric acid derivatives.

32. A process for manufacturing a woven or knitted fabric as defined in claim 22 in which said finishing and treating step using the sericin fixing method is conducted with a cyanuric chloride, cyanurate, its derivatives or cyanuric acid derivatives.

* * * * *

UNITED STATES PATENT AND TRADEMARK OFFICE

CERTIFICATE OF CORRECTION

PATENT NO. : 6,302,922 B1
DATED : October 16, 2001
INVENTOR(S) : Kanehisa

It is certified that error appears in the above-identified patent and that said Letters Patent is hereby corrected as shown below:

Column 1,
Line 65, replace “DMFNU” with -- DMEU --.

Column 2,
Line 2, replace “cyanutic” with -- cyanuric --.

Column 3,
Line 25, replace “thee” with -- the --.

Column 4,
Line 15, insert -- scouring -- between “finishing” and “step”.
Line 19, insert -- scouring -- between “finishing” and “step”.

Column 5,
Line 5, insert -- THE -- between “EMBODYING” and “INVENTION”

Column 6,
Line 2, replace “fifth” with -- with --.

Column 7,
Line 24, replace “31D)/6” with -- 31 D/6 --.

Column 8,
Line 15, replace “31LD/6” with -- 31 D/6 --.
Line 16, replace “21 LD/6” with -- 21 D/6 --.

Column 10,
Line 64, insert -- was -- between “which” and “conducted”.

Column 11,
Line 2, replace “minanino-cho” with -- minamino-cho --.

Column 15,
Line 10, omit “through”.
Line 26, insert -- resistance -- between “crease” and “and”.

UNITED STATES PATENT AND TRADEMARK OFFICE

CERTIFICATE OF CORRECTION

PATENT NO. : 6,302,922 B1
DATED : October 16, 2001
INVENTOR(S) : Kanehisa

It is certified that error appears in the above-identified patent and that said Letters Patent is hereby corrected as shown below:

Column 16,
Line 4, insert -- conducted in the -- between “simultaneously” and “washing”.

Signed and Sealed this

Twenty-fifth Day of June, 2002

*Attest:*

*Attesting Officer*

JAMES E. ROGAN
*Director of the United States Patent and Trademark Office*